US012604924B2

(12) United States Patent
Zitturi et al.

(10) Patent No.: US 12,604,924 B2
(45) Date of Patent: Apr. 21, 2026

(54) WRAPPER PAPER WITH IMPROVED FLAME RESISTANCE

(71) Applicant: DELFORTGROUP AG, Traun (AT)

(72) Inventors: Roland Zitturi, Innsbruck (AT); Dietmar Volgger, Gnadenwald (AT)

(73) Assignee: DELFORTGROUP AG, Traun (AT)

( * ) Notice: Subject to any disclaimer, the term of this patent is extended or adjusted under 35 U.S.C. 154(b) by 627 days.

(21) Appl. No.: 18/003,074

(22) PCT Filed: Apr. 28, 2021

(86) PCT No.: PCT/EP2021/061140
§ 371 (c)(1),
(2) Date: Dec. 22, 2022

(87) PCT Pub. No.: WO2022/002459
PCT Pub. Date: Jan. 6, 2022

(65) Prior Publication Data

US 2023/0337721 A1 Oct. 26, 2023

(30) Foreign Application Priority Data

| | | |
|---|---|---|
| Jul. 1, 2020 | (DE) | 10 2020 117 368.7 |
| Oct. 26, 2020 | (DE) | 10 2020 128 133.7 |
| Nov. 6, 2020 | (DE) | 10 2020 129 301.1 |

(51) Int. Cl.

| | |
|---|---|
| ***A24D 1/02*** | (2006.01) |
| ***A24D 1/20*** | (2020.01) |
| ***D21H 17/10*** | (2006.01) |

(52) U.S. Cl.
CPC ..... *A24D 1/02* (2013.01); *A24D 1/20* (2020.01); *D21H 17/10* (2013.01)

(58) Field of Classification Search
None
See application file for complete search history.

(56) References Cited

U.S. PATENT DOCUMENTS

| | | | | |
|---|---|---|---|---|
| 2,738,791 | A * | 3/1956 | Schur | D21H 5/16 131/365 |
| 2,754,207 | A | 7/1956 | Schur et al. | |
| 4,998,543 | A | 3/1991 | Goodman et al. | |
| 5,038,804 | A | 8/1991 | Chao et al. | |
| 5,109,876 | A | 5/1992 | Hayden et al. | |
| 6,837,248 | B2 | 1/2005 | Zawadzki et al. | |
| 2004/0094173 | A1 | 5/2004 | Ishikawa et al. | |
| 2008/0011312 | A1 | 1/2008 | Matsufuji et al. | |
| 2016/0120214 | A1 | 5/2016 | Volgger et al. | |
| 2018/0092397 | A1 | 4/2018 | Pesendorfer et al. | |
| 2020/0154758 | A1 * | 5/2020 | Minzoni | A24D 1/02 |
| 2022/0256913 | A1 | 8/2022 | Zitturi | |

FOREIGN PATENT DOCUMENTS

| | | | | |
|---|---|---|---|---|
| CN | 108589420 | A | 9/2018 | |
| CN | 110629583 | A | 12/2019 | |
| DE | 102013106516 | B3 | 10/2014 | |
| DE | 102015105882 | A1 | 10/2016 | |
| DE | 102019112777 | B3 | 8/2020 | |
| EP | 1084629 | A1 | 3/2001 | |
| KR | 20040027557 | A | 4/2004 | |
| WO | 2001008514 | A1 | 2/2001 | |
| WO | WO-2011117750 | A2 * | 9/2011 | A24D 1/02 |
| WO | 2011139730 | A1 | 11/2011 | |
| WO | WO-2016063180 | A1 * | 4/2016 | A24F 40/20 |
| WO | 2018098276 | A1 | 5/2018 | |
| WO | 2020104951 | A1 | 5/2020 | |

OTHER PUBLICATIONS

International Searching Authority/EP, International Search Report and Written Opinion of the International Searching Authority, Application No. PCT/EP2021/061140, dated Jul. 14, 2021, 10 pages.
Korean Office Action issued in KR 10-2023-7002080 dated Nov. 24, 2025 with translation (15 pages).

* cited by examiner

*Primary Examiner* — Linda L Gray
(74) *Attorney, Agent, or Firm* — Barclay Damon LLP

(57) ABSTRACT

A wrapper paper is described that is suitable for use on aerosol-generating articles and which comprises pulp fibers and one or more polyphosphates, wherein the pulp fibers make up at least 55% and at most 95% of the mass of the wrapper paper and the polyphosphates are together contained in a concentration of at least 5% and at most 30% with respect to the mass of the wrapper paper. In this regard, the polyphosphates are compounds with the molecular formula $M_{n+2}P_nO_{3n+1}$ or $M_n[H_2P_nO_{3n+1}]$, wherein n is at least 2 and at most 100 and M is a monovalent metal or ammonium ($NH_4^+$).

20 Claims, No Drawings

WRAPPER PAPER WITH IMPROVED FLAME RESISTANCE

CROSS-REFERENCE TO RELATED APPLICATIONS

This application is the national phase entry of International Patent Application No. PCT/EP2021/061140, filed Apr. 28, 2021, and claims the benefit of German Patent Application Nos. 10 2020 117 368.7, filed Jul. 1, 2020, 10 2020 128 133.1, filed Oct. 26, 2020, and 10 2020 129 301.1, filed Nov. 6, 2020, the disclosures of which are incorporated herein by reference in their entirety.

FIELD OF THE INVENTION

The invention relates to a wrapper paper for an aerosol-generating article, which is comparatively heat-resistant and thus, after use of the article, still has sufficient mechanical strength to ensure a trouble-free handling of the article and which additionally has a flame-retardant effect so that the aerosol-generating article manufactured therefrom cannot be smoked like a smoking article. The wrapper paper according to the invention has an improved flame retardation compared to known heat-resistant wrapper papers. This is achieved by means of a high content of particular polyphosphates in the wrapper paper.

BACKGROUND AND PRIOR ART

In the prior art, aerosol-generating articles are known which comprise an aerosol-generating material as well as a paper that wraps the aerosol-generating material, and thereby forms a typically cylindrical rod. In this regard, the aerosol-generating material is a material that releases an aerosol upon heating, wherein the aerosol-generating material is only heated but not burnt. In many cases the aerosol-generating article also comprises a filter which can filter components of the aerosol and which is wrapped by a filter wrapper paper as well as by an additional wrapper paper that connects the filter and the wrapped rod with aerosol-generating material together.

During the intended use of an aerosol-generating article, it is usual for the aerosol-generating material to be heated but not burnt. This heating can, for example, be carried out by an external device, into which the aerosol-generating article is inserted, or by a heat source attached to one end of the aerosol-generating article, which, in order to use of the article, is put into operation by lighting. During heating of the aerosol-generating material also the wrapper paper is heated and thermally degraded. This may cause the wrapper paper to lose so much strength that it tears during removal of the aerosol-generating article from the heating device. This requires an additional cleaning effort by the consumer and is thus not desirable. In addition, with aerosol-generating articles with an integrated heat source, the wrapper paper could lose its strength during heating so that the heat source drops off and a risk of fire arises.

Furthermore, it is desirable to prevent the consumer from inadvertently using aerosol-generating articles in the same way as a cigarette and trying to light an end of the aerosol-generating article so that a combustion or a smoldering process of the aerosol-generating material is started. Thus, the wrapper paper of the aerosol-generating article is required to have flame-retardant properties.

Attempts to make wrapper papers for such aerosol-generating articles heat-resistant or flame-retardant have only been partially successful.

In WO 2015/082648, for example, a wrapper paper is described which is consists of comparatively few pulp fibers and is coated with a composition of calcium carbonate and a binder so that at least 50% of the wrapper paper is formed by calcium carbonate. The disadvantage with this wrapper paper is that because of the thick coating, it is comparatively brittle and generates a lot of dust when manufacturing an aerosol-generating article from the wrapper paper. Furthermore, due to the low pulp fiber content, the tensile strength is not particularly high.

In WO 2011/117750, a wrapper paper is described which consists of a laminate of an aluminum foil and paper. The aluminum foil is facing the aerosol-generating material and partially protects the paper from the effects of heat. The disadvantages with this wrapper paper are the complex manufacturing process and the low biological degradability, because experience has shown that, after use, many aerosol-generating articles are simply disposed of in the environment.

Thus, there is an interest in having a wrapper paper available which still has sufficient tensile strength after heating, is biodegradable and has a particularly efficient flame-retardant effect. Furthermore, the design of wrapper papers for aerosol-generating articles has to take legal regulations, toxicology and the influence of the wrapper paper on the taste of the aerosol-generating article into consideration, inter alia.

BRIEF DESCRIPTION OF THE INVENTION

An objective of the invention is to provide a wrapper paper for an aerosol-generating article that is essentially heat-resistant and strongly flame-retardant and has advantageous properties having regard to strength, processability, biological degradability and influence on taste.

Aerosol-generating articles in the context of this invention are rod-shaped articles which comprise an aerosol-generating material and a wrapper paper that wraps the aerosol-generating material, wherein during the intended use, the aerosol-generating material is only heated but not burnt. For typical aerosol-generating materials, for example a tobacco material, heating without combustion will at all events occur if the aerosol-generating material is heated to a temperature of at most 400° C.

This objective is achieved by means of a wrapper paper for an aerosol-generating article, an aerosol-generating article comprising this wrapper paper, the use of such a wrapper paper for aerosol-generating articles and a process for manufacturing a wrapper paper according to the claimed invention. Further advantageous embodiments are provided in the dependent claims.

The inventors have found that this objective can be achieved by means of a wrapper paper that is suitable for use in aerosol-generating articles and which comprises pulp fibers and one or more polyphosphates, wherein the pulp fibers make up at least 55% and at most 95% of the mass of the wrapper paper and the polyphosphates taken together are contained in a concentration of at least 5% and at most 30% with respect to the mass of the wrapper paper.

According to the findings of the inventors, the high pulp fiber content is necessary in order to obtain a high strength of the wrapper paper. Additives like the polyphosphates according to the invention can hinder the formation of hydrogen bonds between the pulp fibers and thus reduce the strength of the wrapper paper. In order to obtain a good flame-retardant effect, however, at times a high concentration of polyphosphates is necessary so that the proportion of pulp fibers in the wrapper paper needs to be high. Therefore, only a few additional components can be contained in the wrapper paper; in particular, components which further reduce the strength are not desired.

Only the combination of the high pulp fiber content and the suitably chosen concentration of polyphosphates enables a wrapper paper to be manufactured which, due to its initially high strength, has such a high tensile strength after heating that an aerosol-generating article manufactured from it can be removed from the heating device without any problems or that there is no danger that a heat source integrated into the aerosol-generating article could drop off. Furthermore, the flame-retardant effect is so good that the aerosol-generating article cannot be smoked like a cigarette.

The components of the wrapper paper additionally allow for an excellent biological degradability and a very good processability during manufacture of the aerosol-generating article.

The wrapper paper requires pulp fibers for its strength, wherein the pulp fibers make up at least 55% and at most 95% of the mass of the wrapper paper. In order to obtain an even better ratio between pulp fibers and polyphosphates the proportion of pulp fibers can preferably be at least 70% and at most 90% and more particularly preferably at least 75% and at most 90%, each with respect to the mass of the wrapper paper.

The pulp fibers are preferably sourced from one or more plants which are selected from the group consisting of coniferous wood, deciduous wood, annual plants, spruce, pine, fir, beech, birch, eucalyptus, flax, hemp, jute, ramie, bamboo, abaca, sisal, kenaf and cotton. The pulp fibers may also be entirely or partially formed by fibers produced from regenerated cellulose such as Tencel™ fibers, Lyocell™ fibers, viscose fibers or Modal™ fibers.

Preferably, the pulp fibers are formed by pulp fibers from coniferous trees in a proportion of at least 25% and at most 100% with respect to the mass of the pulp fibers, because these pulp fibers provide the wrapper paper with a high strength.

The wrapper paper contains one or more polyphosphates, wherein the polyphosphates taken together make up at least 5% and at most 30% of the mass of wrapper paper. According to the findings of the inventors, the polyphosphates protect pulp fibers inside the paper structure from too much oxidation. Furthermore, according to the findings of the inventors, polyphosphates are strongly hygroscopic and therefore allow water to be deposited in the paper. Upon heating of the paper, water is initially removed from the polyphosphates and therefore the temperature of the pulp fibers is limited. Because the heating process is limited in time during the normal use of the aerosol-generating articles and does not exceed a few minutes, and in particular as it lasts just a few seconds when attempting to light the aerosol-generating article, the water deposited in the polyphosphates makes a substantial contribution to providing a flame-retardant effect. This results in an advantage over wrapper papers that are known in the art.

The flame-retardant effect will increase at increasing concentration of the polyphosphates, but the strength of the wrapper paper will decrease, in particular after heating. Preferably, the proportion of polyphosphates taken together in the wrapper paper is therefore at least 8% and at most 27% of the mass of the wrapper paper and in particular at least 9% and at most 25% of the mass of the wrapper paper.

In the context of this invention, polyphosphates are compounds with the molecular formula $M_{n+2}P_nO_{3n+1}$ or $M_n[H_2P_nO_{3n+1}]$, in which n is at least 2 and at most 100 and M is a monovalent metal or ammonium ($NH_4^+$).

This definition therefore also includes compounds known as oligophosphates, which have the molecular formula $M_{n+2}P_nO_{3n+1}$ or $M_n[H_2P_nO_{3n+1}]$ and in which the value of n is usually at least 2 and at most 10. Furthermore, this definition also includes mixtures of polyphosphates with different values of n with the intervals according to the invention or the preferred intervals or with different monovalent metals M or ammonium, or mixtures of linear and cyclic polyphosphates. It is to be expected and is also within the scope of the invention that in the case of polyphosphates with higher values of n, for example more than 10, a mixture of polyphosphates with different values of n is present. In this context, mixtures of polyphosphates with different values of n fall within the definition provided that a mean value of n lies within an interval according to the invention or a preferred interval, wherein n is not necessarily an integer.

Polyphosphates with a value of n of at least 3 and at most 80 are preferred and particularly preferably have a value of n of at least 10 and at most 35.

Preferably, and independently of the choice of n, M is a monovalent metal selected from the group consisting of lithium, sodium and potassium, or ammonium, and particularly preferably, the monovalent metal is sodium.

More particularly preferably, the polyphosphates have a value of n of at least 15 and at most 30 and the monovalent metal M is sodium. In particular, the polyphosphates comprise sodium hexametaphosphate.

According to the findings of the inventors it is important to know how the polyphosphates are distributed over the thickness of the wrapper paper. Generally, a good flame-retardant effect can in fact be obtained if the polyphosphates are distributed substantially uniformly in the wrapper paper. In a preferred embodiment, however, the wrapper paper is designed such that the side of the wrapper paper facing towards or facing away from the aerosol-generating material contains a higher proportion of polyphosphates than the other side of the wrapper paper. Preferably, the polyphosphates content is higher on that side of the wrapper paper from which the aerosol-generating article manufactured therefrom is heated, because this side is exposed to a higher thermal load. A higher polyphosphates content on this side of the wrapper paper can therefore make a particularly good contribution to the flame-retardant effect. In this manner, the proportion of polyphosphates in the wrapper paper can be reduced without losses regarding the flame-retardant effect and thus the proportion of pulp fibers in the wrapper paper can be increased for the same basis weight, whereupon overall, the strength of the wrapper paper is increased. Alternatively, at this preferred distribution of the polyphosphates in the wrapper paper the basis weight can be reduced without losses regarding the flame-retardant effect, which reduces the material requirements.

The distribution of the polyphosphates in the wrapper paper can be influenced by the manufacturing process, as will be explained further below.

Preferably, the polyphosphates are distributed substantially uniformly over at least 70% of the surface area of the wrapper paper, particularly preferably over at least 95% of the surface area, wherein variations in the proportion of the polyphosphates within these areas are only caused by manufacturing, but are not intentional. In this context, this uniform distribution refers to the distribution with respect to the surface, but not to the distribution in the direction of thickness.

For various reasons, if the wrapper paper is preferably connected to a further layer of a material, in particular a paper layer. This connection is preferably formed by an adhesive connection, but any kind of connection is possible; in particular, it may be sufficient to lay up the wrapper paper and the further layer one on top of the other and roll them up together, so that during manufacture of an aerosol-generating article, the wrapper paper and the further layer will be positioned on top of each other and together wrap the aerosol-generating material. The additional layer can be applied to any of the two sides of the wrapper paper so that, depending on the intended effect, it can be facing towards or away from the aerosol-generating material on an aerosol-generating article manufactured therefrom.

In the case in which the wrapper paper is connected to one or more paper layers or in fact to layers of other materials such as aluminum foil, plastic foil, foil produced from regenerated cellulose such as cellulose hydrate (Cellophane®), the aforementioned requirements regarding the proportion of pulp fibers and polyphosphates and all further properties mentioned below apply only to the wrapper paper per se and, unless it is explicitly mentioned, not to the further layers connected to it.

One reason for connecting the wrapper paper to a further layer can, for example, be that polyphosphates turn the wrapper paper a dark color under a thermal load. This disadvantage can be overcome by connecting the wrapper paper according to the invention to a further layer of a material so that the wrapper paper according to the invention is facing towards the aerosol-generating material and the further layer is located on the side facing away from the aerosol-generating material. Under a thermal load, this further layer then covers the wrapper paper so that the color visible from the outside is not or is only insignificantly changed.

In this particularly preferred embodiment, the wrapper paper is therefore connected to an additional paper layer, wherein the additional paper layer comprises pulp fibers and white filler particles and the white filler particles make up at least 15% and at most 45% of the mass of the paper layer. Particularly preferably, the white filler particles are calcium carbonate particles. The white filler particles provide the paper layer with a white color and a high opacity, so that the discoloration of the wrapper paper according to the invention located under it is not or is only slightly visible.

A further reason for connecting the wrapper paper to an additional layer of a material is, for example, to prevent the formation of stains on the wrapper paper. The aerosol-generating material can contain oils, for examples flavors, which penetrate the wrapper paper during storage or upon heating and cause stains. This problem can be overcome by connecting the wrapper paper to an additional layer of a material.

In this particularly preferred embodiment, the wrapper paper is therefore connected to an additional paper layer, wherein the additional paper layer has an air permeability, measured in accordance with ISO 2965:2019, of at least 5 $cm^3/(cm^2 \cdot min \cdot kPa)$ and at most 30000 $cm^3/(cm^2 \cdot min \cdot kPa)$ and the basis weight of the additional paper layer is at least 10 $g/m^2$ and at most 30 $g/m^2$. The air permeability of the additional paper layer is the consequence of a porous structure, which hinders the transfer of oils or other components through the paper layer.

A further reason for connecting the wrapper paper to an additional layer of material is, for example, to increase the stiffness of the wrapper paper. Inside the aerosol-generating article there are often cavities, so that the consumer can accidentally compress the aerosol-generating article during handling of the aerosol-generating article and thereby deform it such that, for example, it cannot be inserted into the heating device anymore. A wrapper paper which is connected to a further layer with a high stiffness can prevent this.

In this particularly preferred embodiment, the wrapper paper is therefore connected to an additional paper layer, wherein the additional paper layer has a high basis weight, which is at least 30 $g/m^2$ and at most 100 $g/m^2$, because this also leads to a high bending stiffness.

While paper layers are generally preferred for the additional layer provided on the wrapper paper for the aforementioned or also for other reasons because of their good biological degradability, less preferably, the additional layer can also be formed by aluminum foil, plastic foil or foil produced from regenerated cellulose such as cellulose hydrate (Cellophane®).

The wrapper paper according to the invention or the additional paper layer to which it is connected for the aforementioned or also for other reasons can contain further components. This includes, for example, filler materials, sizing agents, wet strength agents, additives, processing aids, humectants and flavors. The skilled person can select these components according to experience. In particular, wet strength agents can be advantageous for use on aerosol-generating articles because the aerosol formed during use of the aerosol-generating article has a high moisture content. The wrapper paper can absorb part of the water from the aerosol, whereupon its strength is reduced. This can be partially prevented by the use of wet strength agents.

The filler materials in the wrapper paper according to the invention can contribute to reducing the discoloration of the wrapper paper. The filler materials, however, reduce the tensile strength of the wrapper paper, so that their proportion should not be too high. Preferably, the proportion of filler materials in the wrapper paper is therefore at least 0% and at most 45%, particularly preferably at least 0% and at most 35% and more particularly preferably at least 0% and at most 25%, each with respect to the mass of the wrapper paper.

The filler material is preferably selected from the group consisting of calcium carbonate, magnesium carbonate, titanium dioxide, magnesium oxide, magnesium hydroxide, aluminum hydroxide, kaolin, talcum and mixtures thereof. A particularly preferred filler material is bentonite because, like the polyphosphates, it can absorb large quantities of water and thereby additionally contributes to the flame-retardation. By using bentonite, the proportion of polyphosphates in the wrapper paper can be in the lower range of the intervals according to the invention or the preferred intervals without negatively affecting the flame-retardant effect.

According to the findings of the inventors, it is even possible to obtain sufficient flame-retardation by using bentonite alone, so that polyphosphates could be dispensed with entirely.

In a preferred embodiment, the wrapper paper is coated or impregnated with a substance selected from the group consisting of starch such as corn starch, potato starch or tapioca starch; starch derivatives such as carboxymethyl starch or oxidized starch; cellulose derivatives such as carboxymethyl cellulose, methyl cellulose, hydroxymethyl cellulose, as well as their salts; polysaccharides such as alginates; polyvinyl alcohol; polyvinyl acetate; ethyl-vinyl-acetate; gelatin; gums such as gum Arabic, guar gum, locust bean gum or gum tragacanth; or mixtures thereof. In this preferred embodiment, the proportion of these substances taken together is at least 0.1% and at most 20% of the mass of the wrapper paper. This preferred embodiment offers a resistance against the penetration of oils as an additional advantage. The aerosol-generating material can contain oils, for example, flavors, which penetrate the wrapper paper during storage or use of the aerosol-generating article and lead to stains. The resistance against the penetration of oils can be determined in accordance with TAPPI T559 cm-12 and is indicated as the KIT level. In this preferred embodiment, the KIT level is at least 3 and at most 8.

When using a starch or a starch derivative, depending on the type of the application process, it is recommended that the composition to be applied should not be introduced into or applied to the paper in a single process step together with the polyphosphates, because the polyphosphates can cause a clumping of the starch or the starch derivative in the composition to be applied.

The basis weight of the wrapper paper can vary, wherein a higher basis weight generally also means a higher tensile strength. With a higher basis weight, the wrapper paper will also become stiffer and more difficult to process and the material requirements increase. Preferably, the basis weight of the wrapper paper according to the invention is thus at least 15 $g/m^2$ and at most 120 $g/m^2$, particularly preferably at least 20 $g/m^2$ and at most 80 $g/m^2$. The basis weight of the wrapper paper can be determined in accordance with ISO 536:2019.

The thickness of the wrapper paper primarily influences the bending stiffness and the heat transfer within the wrapper paper. A high bending stiffness is advantageous, because the aerosol-generating article manufactured from the wrapper paper deforms less, but on the other hand, a high bending stiffness can cause problems because of restoring forces when the aerosol-generating material is wrapped with the wrapper paper. A high thickness slows down the heat transfer through the wrapper paper, and for this reason is also of advantage for some aerosol-generating articles. Preferably, the thickness of the wrapper paper according to the invention is at least 25 μm and at most 150 μm, and particularly preferably at least 40 μm and at most 100 μm. The thickness can be determined in accordance with ISO 534:2011 on a single layer.

The tensile strength of the wrapper paper, measured in the longitudinal direction, is at least 10 N/15 mm and at most 100 N/15 mm, particularly preferably at least 20 N/15 mm and at most 80 N/15 mm. A high tensile strength can be achieved by a high pulp fiber content. However, this also means higher material requirements, for which reason it does not make sense to desire to obtain a particularly high tensile strength. The preferred intervals allow for a particularly advantageous combination of trouble-free processability and material requirements. The tensile strength can be determined in accordance with ISO 1924-2:2008.

The aerosol-generating material often contains humectants so that during heating, the aerosol that is generated has a comparatively high moisture content. This moisture can reduce the strength of the wrapper paper, for which reason it is advantageous, if the wrapper paper also has a corresponding wet strength. The wet tensile strength in the longitudinal direction is therefore at least 1 N/1 mm and at most 10 N/1 mm and particularly preferably at least 2 N/15 mm and at most 8 N/15 mm. The wet tensile strength in the longitudinal direction can be determined in accordance with ISO 12625-5:2016.

The air permeability of the wrapper paper can be low. A low air permeability is often obtained by more intensive refining of the pulp fibers. This also contributes to an increase in strength, so that preferably, the air permeability is at least 0 $cm^3/(cm^2 \cdot min \cdot kPa)$ and at most 80 $cm^3/(cm^2 \cdot min \cdot kPa)$ and particularly preferably at least 0 $cm^3/(cm^2 \cdot min \cdot kPa)$ and at most 30 $cm^3/(cm^2 \cdot min \cdot kPa)$. The air permeability can be determined in accordance with ISO 2965:2019.

If the wrapper paper according to the invention is visible from the outside on the aerosol-generating article, the optical properties may be of importance. Generally, a high opacity and a high brightness are desired. Both properties can be essentially influenced by the type and amount of filler material in the wrapper paper. Preferably, the opacity is at least 40% and at most 90%, particularly preferably at least 45% and at most 90%. Preferably, the brightness is at least 80% and at most 95%, particularly preferably at least 83% and at most 90%.

Aerosol-generating articles can be manufactured from the wrapper paper according to the invention in accordance with processes that are known in the art. An aerosol-generating article according to the invention thus comprises an aerosol-generating material and a wrapper paper according to one of the aforementioned embodiments, wherein the wrapper paper wraps the aerosol-generating material.

In a preferred embodiment of the aerosol-generating article, the proportion of said polyphosphates is higher on one side of the wrapper paper than on the other side and the side with the higher proportion of polyphosphates is facing towards or away from the aerosol-generating material. The choice as to which of the two sides is preferably facing the aerosol-generating materials can therefore depend on the side from which the aerosol-generating material is heated.

In a particularly preferred embodiment, the aerosol-generating article is an electrically heated article, wherein the heating originates from the aerosol-generating material, that is, from the inside.

In this embodiment, for example, a ceramic tip equipped with heating wires penetrates the aerosol-generating material when the aerosol-generating article is inserted into the heating device. The highest temperatures therefore occur inside the aerosol-generating article and the wrapper paper is under less thermal load, so that the proportion of polyphosphates can be selected so as to be lower; in particular, the proportion of polyphosphates in the wrapper paper in this embodiment is at least 5% and at most 25% of the mass of the wrapper paper.

In a further particularly preferred embodiment of the aerosol-generating article, the aerosol-generating article is an electrically heated article, wherein the heating is from the outside through the wrapper paper.

In this embodiment, all of the heat has to be conducted through the wrapper paper into the aerosol-generating material so that the thermal load of the wrapper paper is higher and therefore the proportion of polyphosphates in the wrapper paper may be selected so as to be higher; in particular, the proportion of polyphosphates in the wrapper paper in this embodiment is at least 10% and at most 30% of the mass of the wrapper paper.

The wrapper paper according to the invention can be advantageously used in aerosol-generating articles, for which reason too, the use of the wrapper paper according to the invention in aerosol-generating articles is an objective of the invention.

The wrapper paper according to the invention can be manufactured according to the following process according to the invention, comprising the steps A to G.

A—suspending pulp fibers in an aqueous suspension,

B—refining the suspended pulp fibers in a refining unit,

C—applying the suspension on a running wire,

D—forming a fiber web by de-watering the suspension,

E—pressing the fiber web,

F—drying the fiber web,

G—rolling up the fiber web, wherein between the steps F and G, at least one composition containing one or more polyphosphates is applied to the fiber web and the fiber web is dried in order to form the wrapper paper, and wherein the wrapper paper from step G comprises pulp fibers and one or more polyphosphates and the pulp fibers make up at least 55% and at most 95% of the mass of the wrapper paper and the polyphosphates taken together make up at least 5% and at most 30% of the mass of the wrapper paper.

Preferably, the step of applying the composition containing polyphosphates to the fiber web is carried out by one or a combination of two or more of the following steps:

F.1 application of a composition containing polyphosphates to the fiber web in a size press of a paper machine, F.2 one-sided application of a composition containing polyphosphates to the fiber web in a film press or in a coating unit of a paper machine, and F.3 one-sided application of a composition containing polyphosphates to the fiber web by printing, in particular by roto-gravure printing or by spraying.

In this regard, step F.1 is carried out in a size press and thus the fiber web is therefore impregnated with a composition containing polyphosphates. This variation offers the advantage that it can be carried out easily. It generally leads to a substantially uniform distribution of the polyphosphates over the thickness of the wrapper paper, so that comparatively more polyphosphates are needed to achieve the desired effect. However, it is in fact also possible to adjust the setting of the size press in this step, so that the polyphosphates are unevenly distributed over the thickness of the fiber web and thus of the wrapper paper.

According to step F.2, the composition containing polyphosphates is applied to one side of the fiber web in a film press or in a coating unit. This brings about an uneven distribution of the polyphosphates over the thickness of the wrapper paper and the high flame-retardant effect can be obtained with a smaller proportion of the polyphosphates in the wrapper paper.

According to step F.3, the composition containing polyphosphates is applied to one side of the fiber web by printing or spraying, wherein in particularly preferred embodiments, the composition is printed on one side of the fiber web in a roto-gravure printing unit. In this regard, the fiber web is preferably dried before step F.3, rolled up and unrolled again. In the rolled-up state the fiber web can then be transported to a further machine on which the application of the composition is carried out by printing or spraying. While the steps F.1 and F.2 are as a rule carried out on the same paper machine on which the wrapper paper is manufactured, the application in accordance with step F.3 typically takes place in a separate machine.

In a highly particularly preferred embodiment, the steps F.1 and F.3 are combined so that firstly, in a step F.1, the fiber web is impregnated with a composition containing polyphosphates in a size press and in step F.3, a further composition containing polyphosphates is printed on one side of the fiber web in a roto-gravure printing unit. In this more particularly preferred embodiment, the polyphosphates are both distributed in the wrapper paper and are present in a higher concentration on one side of the wrapper paper, whereupon the flame-retardant effect can again be significantly increased.

In a further highly particularly preferred embodiment, the steps F.1 and F.2 are combined, wherein the step F.1 is carried out in a size press and the step F.2 in a coating unit. In this highly particularly preferred embodiment, the wrapper paper can be manufactured particularly efficiently because, for example, all of the application units can be integrated into one paper machine.

Independently of which of the steps F.1, F.2 or F.3 is or are employed, the composition containing polyphosphates is preferably applied to at least 70% of the surface area of the wrapper paper and particularly preferably to at least 95% of the surface area of the wrapper paper.

The composition that is used in steps F.1, F.2 or F.3 contains polyphosphates and a solvent, wherein the solvent is preferably water. The amount of polyphosphates in the composition can vary and depends on the type of the application process, the applied amount and the desired amount of polyphosphates in the wrapper paper. The skilled person will be capable of determining a suitable composition with these considerations in mind and of designing the application process accordingly. In a preferred embodiment of the process, the composition can additionally contain carboxymethyl cellulose, which fixes the polyphosphates in the fiber web as a binder and also increases the strength of the wrapper paper. In a particularly preferred embodiment, the composition contains at least 0.1% and at most 15% carboxymethyl cellulose with respect to the mass of the composition.

In a highly particularly preferred embodiment, one of the steps F.1 or F.2 is carried out, the fiber web is then dried, rolled up and unrolled again, and then step F.3 is carried out, wherein the fiber web in the dried, rolled-up state before step F.3 preferably contains the polyphosphates in an amount of at least 4% and at most 20% of the mass of the fiber web in this dried, rolled-up state.

If the steps F.1, F.2 and/or F.3 are combined in any form, the compositions containing polyphosphates, which are used in steps F.1, F.2 and/or F.3 can be the same or different.

In the wrapper paper after step G the pulp fibers make up at least 55% and at most 95% of the mass of the wrapper paper. In order to obtain an even better ratio between pulp fibers and polyphosphates, the proportion of pulp fibers can be at least 70% and at most 90% and more particularly preferably at least 75% and at most 90%, each with respect to the mass of the wrapper paper after step G.

The pulp fibers in step A are preferably sourced from one or more plants which are selected from the group consisting of coniferous trees, deciduous trees, annual plants, spruce, pine, fir, beech, birch, eucalyptus, flax, hemp, jute, bamboo, ramie, abaci, sisal, kenaf and cotton. The pulp fibers can also be fibers produced in their entirety or in part from regenerated cellulose such as Tencel™ fibers, Lyocell™ fibers, viscose fibers or Modal™ fibers.

Preferably, the pulp fibers in step A are formed by pulp fibers from coniferous trees in a proportion of at least 25% and at most 100% with respect to the mass of the pulp fibers, because these pulp fibers provide the wrapper paper in step G with high strength.

The wrapper paper after step G contains one or more polyphosphates, wherein the polyphosphates together make up at least 5% and at most 30% of the mass of the wrapper paper. Preferably, the proportion of the polyphosphates in the wrapper paper together is at least 8% and at most 27% of the mass of the wrapper paper and more particularly preferably at least 9% and at most 25% of the mass of the wrapper paper.

Polyphosphates in the context of the process according to the invention are compounds with the molecular formula $M_{n+2}P_nO_{3n+1}$ or $M_n[H_2P_nO_{3n+1}]$, in which n is at least 2 and at most 100 and M is a monovalent metal or ammonium ($NH_4^+$).

This definition thus also includes compounds known as oligophosphates which have the molecular formula $M_{n+2}P_nO_{3n+1}$ or $M_n[H_2P_nO_{3n+1}]$ and in which the value of n is typically at least 2 and at most 10. Furthermore, this definition also includes mixtures of polyphosphates with different values of n within the intervals according to the invention or the preferred intervals or with different monovalent metals M or ammonium, or mixtures of linear and cyclic polyphosphates. It is to be expected and within the scope of the invention that for polyphosphates with higher values of n, for example more than 10, a mixture of polyphosphates with different values of n is present. In this context, mixtures of polyphosphates with different values of n fall within the definition provided that a mean value of n lies within an interval according to the invention or a preferred interval, wherein n is not necessarily an integer.

Polyphosphates with a value of n of at least 3 and at most 80 are preferred, particularly preferably with a value of n of at least 10 and at most 35.

Preferably, and independently of the choice of n, M is a monovalent metal selected from the group consisting of lithium, sodium and potassium, or ammonium; particularly preferably, the monovalent metal is sodium.

Particularly preferably, the polyphosphates have a value of n of at least 15 and at most 30 and the monovalent metal M is sodium. In particular, the polyphosphate is sodium hexametaphosphate.

In a preferred embodiment, after step G the wrapper paper is a wrapper paper according to one of the aforementioned embodiments.

DESCRIPTION OF THE PREFERRED EMBODIMENTS

Some preferred embodiments of wrapper papers according to the invention will now be described.

A base paper for the wrapper paper according to the invention was manufactured on a fourdrinier paper machine. To this end, pulp fibers were suspended in water (step A) and refined in a refining unit (step B). Then the suspension was applied to a running wire (step C) and de-watered therein in order to form a fiber web (step D). The fiber web was pressed (step E) in order to further de-water it and dried by contact with heated drying cylinders (step F).

The basis weight of the base paper was about 30 g/m$^2$ and, apart from the processing aids and additives that are routine in paper manufacturing, it contained only pulp fibers and no filler materials. By means of further steps, a total of six wrapper papers according to the invention were manufactured from the base paper. These steps were also carried out in part in the paper machine during manufacture of the base paper.

In the size press of the paper machine, the fiber web was impregnated on both sides over the entire surface with a composition comprising water and polyphosphate, wherein n was between 23 and 30 and the monovalent metal M was sodium (step F.1) and the fiber web was then dried by contact with heated drying cylinders. Finally, the fiber web was rolled up (step G). The concentration of the polyphosphates in the composition was varied so that different wrapper papers according to the invention were obtained.

In a further step, a composition comprising water, sodium polyphosphates and carboxymethyl cellulose was applied over substantially the entire surface of one side of the previously impregnated wrapper paper by means of a rotogravure printing process (step F.3). Here again, the concentration of the polyphosphates was varied so that a total of six different wrapper papers P1 to P6 according to the invention were obtained. The amount of polyphosphates after impregnation in the size press (step F.1) and after printing the compositions (step F.3) is shown in Table 1.

TABLE 1

| | | Concentration of polyphosphates, as a % with respect to the mass of the wrapper paper | |
|---|---|---|---|
| Paper | Code | after step F.1 | after step F.3 |
| P1 | Q71548 | 8 | 15 |
| P2 | | 10 | 18 |
| P3 | | 13 | 23 |
| P4 | | 12 | 21 |
| P5 | | 20 | 25 |
| P6 | | 19 | 29 |

It should be noted that the wrapper papers obtained after step F.1 already represent embodiments according to the invention.

To test the flame-retardant properties of the wrapper paper, the paper was held in a flame in an inclined position so that both sides of the paper were surrounded by the flame. For all of the wrapper papers, it was found that the paper became charred but no combustion and no self-sustaining smoldering process was started.

Aerosol-generating articles were manufactured from the wrapper papers P1 to P2 without any problems, so that these wrapper papers are suitable for use in aerosol-generating articles. An influence on the taste of the aerosol-generating article could not be detected.

A further wrapper paper according to the invention was manufactured using a base paper with 20 g/m$^2$ made from pulp fibers and without filler materials, which was impregnated in the size press (step F.1) on both sides over the entire surface with a composition comprising water and polyphosphates, so that afterwards, it contained 8% polyphosphates with respect to the mass of the wrapper paper. The wrapper paper was connected to a further paper layer by lamination. The further paper layer had a basis weight of 24 g/m$^2$, a filler content of 28% with respect to the mass of the paper layer and an air permeability of 75 cm$^3$/(cm$^2$·min·kPa). For this wrapper paper too, a good flame-retardant effect was discerned. An aerosol-generating article was manufactured and after use, it was clearly recognizable that because of the further paper layer lying on the outside, the discoloration of the wrapper paper was substantially less perceptible.

A further wrapper paper according to the invention was manufactured using a base paper with 30 g/m$^2$, wherein the base paper contained pulp fibers and also contained bentonite as a filler material in an amount of about 34% with respect to the mass of the base paper. This base paper was impregnated in the size press (step F.1) on both sides over the entire surface with a composition comprising water and polyphosphates, so that afterwards it contained about 5% polyphosphates. Despite the low polyphosphates content, a good flame-retardant effect could be discerned. The inventors assume that the high water content of bentonite contributes to the flame-retardant effect.

An aerosol-generating article was manufactured from this wrapper paper according to the invention and it was found that due to the lower polyphosphates content, the discoloration of the wrapper paper was less obvious.

The wrapper papers according to the invention are thus very well suited for use in aerosol-generating articles along with a good biological degradability, and have a flame-retardant effect in a better combination of properties than comparable wrapper papers of the prior art.

The invention claimed is:

1. Aerosol-generating article, which comprises a wrapper paper and an aerosol-generating material, wherein the aerosol-generating material is configured to be heated but not bort during an intended use and wherein said aerosol generating material is configured to release said aerosol upon heating to a temperature of 400° C. or less, wherein the wrapper paper wraps the aerosol-generating material, wherein said wrapper paper comprises pulp fibers and one or more polyphosphates, wherein the pulp fibers make up at least 70% and at most 95% of mass of the wrapper paper and the polyphosphates are together contained in a concentration of at least 5% and at most 30% with respect to said mass of the wrapper paper, wherein the polyphosphates are compounds with the molecular formula $M_{n+2}P_nO_{3n+1}$ or $M_n[H_2P_nO_{3n+1}]$, wherein n is at least 2 and at most 100 and M is a monovalent metal or ammonium ($NH_4^+$).

2. Aerosol-generating article, which comprises a wrapper paper and an aerosol-generating material, wherein the wrapper paper wraps the aerosol-generating material, wherein said wrapper paper comprises pulp fibers and one or more polyphosphates, wherein the polyphosphates are together contained in a concentration of at least 5% and at most 30% with respect to mass of the wrapper paper, wherein the polyphosphates are compounds with the molecular formula $M_{n+2}P_nO_{3n+1}$ or $M_n[H_2P_nO_{3n+1}]$, wherein n is at least 2 and at most 100 and M is a monovalent metal or ammonium ($NH_4^+$), and wherein a proportion of pulp fibers in said wrapper paper is at least 75% and at most 90%, each with respect to said mass of the wrapper paper.

3. Aerosol-generating article according to claim 1, in which the pulp fibers are sourced from coniferous trees in a proportion of at least 25% and at most 100% with respect to mass of the pulp fibers.

4. Aerosol-generating article according to claim 1, in which a proportion of polyphosphates in the wrapper paper is at least 9% and at most 25% of said mass of the wrapper paper.

5. Aerosol-generating article according to claim 1, wherein for the polyphosphates, n in the molecular formula $M_{n+2}P_nO_{3n+1}$ or $M_n[H_2P_nO_{3n+1}]$ is at least 3 and at most 80.

6. Aerosol-generating article according to claim 1, wherein for the polyphosphates, the monovalent metal M in the molecular formula $M_{n+2}P_nO_{3n+1}$ or $M_n[H_2P_nO_{3n+1}]$ is selected from the group consisting of lithium, sodium and potassium.

7. Aerosol-generating article according to claim 1, wherein for the polyphosphates, n in the molecular formula $M_{n+2}P_nO_{3n+1}$ or $M_n[H_2P_nO_{3n+1}]$ is at least 15 and at most 30 and the monovalent metal M is sodium.

8. Aerosol-generating article according to claim 1, wherein the polyphosphates comprise sodium hexametaphosphate.

9. Aerosol-generating article according to claim 1, wherein the wrapper paper is connected to a further layer of a material, and wherein the further layer of a material is a layer of aluminum foil, plastic foil, foil produced from regenerated cellulose or a foil produced from cellulose hydrate.

10. Aerosol-generating article, which comprises a wrapper paper and an aerosol-generating material, wherein the wrapper paper wraps the aerosol-generating material, wherein said wrapper paper comprises pulp fibers and one or more polyphosphates, wherein the pulp fibers make up at least 70% and at most 95% of mass of the wrapper paper and the polyphosphates are together contained in a concentration of at least 5% and at most 30% with respect to the mass of the wrapper paper, wherein the polyphosphates are compounds with the molecular formula $M_{n+2}P_nO_{3n+1}$ or $M_n[H_2P_nO_{3n+1}]$, wherein n is at least 2 and at most 100 and M is a monovalent metal or ammonium ($NH_4^+$), wherein the wrapper paper is connected to a further layer of a material, and wherein the further layer is a paper layer, wherein said paper layer comprises pulp fibers and white filler particles and the white filler particles make up at least 15% and at most 45% of mass of the paper layer and the paper layer faces away from the aerosol-generating material during an intended use.

11. Aerosol-generating article according to claim 1, wherein the wrapper paper is connected to a further layer of a material and wherein the further layer is a paper layer, wherein the paper layer has an air permeability, measured in accordance with ISO 2965:2019, of at least 5 $cm^3/(cm^2 \cdot min \cdot kPa)$ and at most 30000 $cm^3/(cm^2 \cdot min \cdot kPa)$ and a basis weight of the paper layer is at least 10 $g/m^2$ and at most 30 $g/m^2$.

12. Aerosol-generating article according to claim 1, wherein said wrapper paper has a KIT level determined in accordance with TAPPI T559 cm-12, which is at least 3 and at most 8.

13. Aerosol-generating article according to claim 1, wherein the wrapper paper has a basis weight of at least 15 $g/m^2$ and at most 120 $g/m^2$.

14. Aerosol-generating article according to claim 1, wherein the wrapper paper has a wet tensile strength in accordance with ISO 12625-5:2016 in a longitudinal direction of at least 1 N/15 mm and at most 10 N/15 mm.

15. Aerosol-generating article according to claim 1, wherein the wrapper paper has an air permeability in accordance with ISO 2965:2019 of at least 0 $cm^3/(cm^2 \cdot min \cdot kPa)$ and at most 30 $cm^3/(cm^2 \cdot min \cdot kPa)$.

16. Aerosol-generating article according to claim 1, wherein the wrapper paper has an opacity of at least 40% and at most 90%, and/or a brightness of at least 80% and at most 95%.

17. Aerosol-generating article according to claim 1, wherein a proportion of polyphosphates on one side of the wrapper paper is higher than on the other side and the side with a higher proportion of polyphosphates is facing towards or away from the aerosol-generating material.

18. Aerosol-generating article according to claim 1, wherein the aerosol-generating article is an electrically heated aerosol-generating article, and the aerosol-generating material of the aerosol-generating article is heated from an inside during its intended use, and the wrapper paper contains polyphosphates in an amount of at least 5% and at most 25% with respect to said mass of the wrapper paper.

19. Aerosol-generating article according to claim 1, wherein the aerosol-generating article is an electrically heated aerosol-generating article, and the aerosol-generating material of the aerosol-generating article is heated from an outside during its intended use, and the wrapper paper contains polyphosphates in an amount of at least 10% and at most 30% with respect to said mass of the wrapper paper.

20. Aerosol-generating article according to claim 1, wherein for the polyphosphates, n in the molecular formula $M_{n+2}P_nO_{3n+1}$ or $M_n[H_2P_nO_{3n+1}]$ is at least 10 and at most 35.

* * * * *